US005340319A

United States Patent [19]

Enomoto et al.

[11] Patent Number: 5,340,319

[45] Date of Patent: Aug. 23, 1994

[54] ELECTRIC CONNECTOR FOR PRINTED CIRCUIT BOARDS

[75] Inventors: Masahiro Enomoto, Tokyo; Minoru Fukushima, Yokohama, both of Japan

[73] Assignee: Molex Incorporated, Lisle, Ill.

[21] Appl. No.: 100,819

[22] Filed: Aug. 2, 1993

[30] Foreign Application Priority Data

Aug. 7, 1992 [JP] Japan ..... 4-061503[U]

[51] Int. Cl.[5] ..... H01R 13/00

[52] U.S. Cl. ..... 439/75

[58] Field of Search ..... 439/74, 75, 65, 78, 439/79, 44–54

[56] References Cited

U.S. PATENT DOCUMENTS

| | | | |
|---|---|---|---|
| 4,331,370 | 5/1982 | Andrews et al. | 439/75 |
| 4,363,530 | 12/1982 | Verhoeven | 339/17 |
| 4,787,862 | 11/1988 | Lee | 439/502 |
| 4,939,624 | 7/1990 | August et al. | 439/75 |
| 5,013,249 | 5/1991 | Linderman et al. | 439/75 |
| 5,055,073 | 10/1991 | Yamada et al. | 439/75 |
| 5,169,347 | 12/1992 | Sang | 439/885 |

FOREIGN PATENT DOCUMENTS 63-266687 4/1987 Japan .

*Primary Examiner*—Joseph H. McGlynn
*Attorney, Agent, or Firm*—Stephen Z. Weiss

[57] ABSTRACT

Disclosed is an improvement in an electric connector for connecting two spaced apart parallel printed circuit boards having a plurality of needle-like pin terminals arranged laterally at regular intervals between its upper and lower wafers, the upper and lower extensions of the needle-like pin terminals extend beyond the upper and lower wafers being connected to selected conductors on upper and lower printed circuit boards. According to the present invention the needle-like pin terminals freely pass through the longitudinal pin-receiving openings made in the upper and lower wafers, and metal tie rods are press-fit in opposite longitudinal rod-insertion apertures made at the opposite ends of the upper and lower wafers, and are detachably fixed thereto, thereby constituting a rigid integrity. If it is desired that another couple of printed circuit boards are to be separated a shorter or longer distance, the pin terminals and tie-rods are simply removed from the upper and lower wafers, and the ones of appropriate length for spanning the shorter or longer distance are inserted in the upper and lower wafers.

5 Claims, 7 Drawing Sheets

ELECTRIC CONNECTOR FOR PRINTED CIRCUIT BOARDS

FIELD OF THE INVENTION

The present invention relates to an arrangement including a connector interconnecting two spaced apart parallel printed circuit boards, and more particularly to an improved electric connector which is designed to absorb relative positional misalignments, if any, between the two printed circuit boards to be connected, thereby assuring that an electrical connection is made therebetween.

DESCRIPTION OF THE PRIOR ART

A variety of electric connectors have been widely used for connecting one printed circuit board to another printed circuit board with or without the use of a female receptacle connector attached to one of these printed circuit boards. Each electric connector comprises upper and lower pin mounts or wafers, each having a plurality of needle-like pin terminals fixed laterally at regular intervals. Such electric connectors are equipped with means to absorb lateral front, rear, right or left misalignments, if any, between the two printed circuit boards.

Japanese Patent Application Public Disclosure No. 63-266787 shows a conventional electrical connector. The connector comprises upper and lower wafers connected by opposite tie rods and a plurality of needle-like pin terminals held laterally at regular intervals between the opposite tie rods and extending longitudinally between the upper and lower wafers.

An electric connector such as shown in Japanese Patent Application Public Disclosure No. 63-266787 has a plurality of needle-like pin terminals of predetermined length, and tie rods all of which are integrally connected to the upper and lower wafers. Therefore, it is necessary that a set of electric connectors each having pin terminals and tie rods of different lengths be available to permit selection of an appropriate one to connect two printed circuit boards which are separated at a distance equal to the length of the pin terminals of the selected electric connector. In this connection a corresponding number of plastic molds must be prepared for each specific distance that the boards are to be separated. This prevents reduction of manufacturing costs.

SUMMARY OF THE INVENTION

One object of the present invention is to provide an electric connector which permits electric connection between two printed circuit boards separated at a desired distance simply by selecting and using a plurality of needle-like pin terminals whose length is equal to the desired distance, thus eliminating the necessity of preparing a plurality of different connectors each having upper and lower wafers integrally connected by opposite tie-rods at individual different distances. Thus, with the new invention a single plastic mold is prepared to provide upper and lower wafers of one size, and accordingly the manufacturing cost can be reduced. An electric connector according to the present invention is equipped with means to assure that it may have a good mechanical strength.

To attain this object an arrangement is provided including a connector interconnecting two spaced apart, parallel printed circuit boards. The connector includes a pair of dielectric wafers, each wafer having a plurality of pin receiving openings therein, alignable with each other. One wafer is mounted adjacent one board and the second wafer is mounted adjacent the other board. The connector also includes a plurality of conductive pin terminals, each adapted to be received in corresponding openings of both wafers such that the ends of the terminals extend beyond their respective wafer into the printed circuit boards and the wafers are axially spaced-apart along the terminals. The improvement of this connector comprises at least two support rods mounted between the two wafers, each support rod is press fit into an aperture in both wafers and each support rod being stiffer than the terminals. The support rods add rigidity and stability in the arrangement so that the boards will not move relative to one another beyond a predetermined amount thereby preventing over stressing of the terminals. The improvement also includes the terminal receiving openings of at least one wafer being greater than or equal to the cross section of the terminals to allow the terminals to slide within the openings when the boards move relative to one another.

Assume that a first electric connector is used to connect two spaced apart printed circuit boards separated by a first distance, and that it is desired that two other similar printed circuit boards be electrically separated by a second distance. Tie-rods and terminal pins of the length corresponding to the second distance are selected, and used to make up the second electric connector while the same upper and lower wafers which were used in the first electric connector are used in the second electric connector. The tie-rods can be easily fixed to the upper and lower wafers. Thus, to meet different board-to-board distances only a few different sets of tie-rods and terminal pins of different lengths are needed rather than different sets of connectors with not only tie rods and terminal pins of different lengths but also two integrally formed wafers.

According to one aspect of the present invention said pin-receiving openings of one of said wafers have an increased diameter at the opening end facing the other one of said wafers pairs to define annular gaps around said pin terminals. These annular gaps have the effect of absorbing relative positional misalignments if any, between the two printed circuit boards to be connected by allowing the pin terminals to yieldingly bend a predetermined amount without placing high stress on the portion of the terminal exiting the gap, thereby assuring that an electrical connection is maintained between the two printed circuit boards.

Specifically, to define annular gaps around said pin terminals in said one wafer, said pin receiving openings may be divergent toward the lower surface of said upper wafer. In other words each pin-receiving opening has an upward-tapering wall to define a longitudinal hole gradually upward decreasing in its diameter.

BRIEF DESCRIPTION OF THE DRAWINGS

Other objects and advantages of the present invention will be understood from the following description of preferred embodiments of the present invention, which are shown in accompanying drawings.

DETAILED DESCRIPTION OF THE PREFERRED EMBODIMENTS

Figure 1:
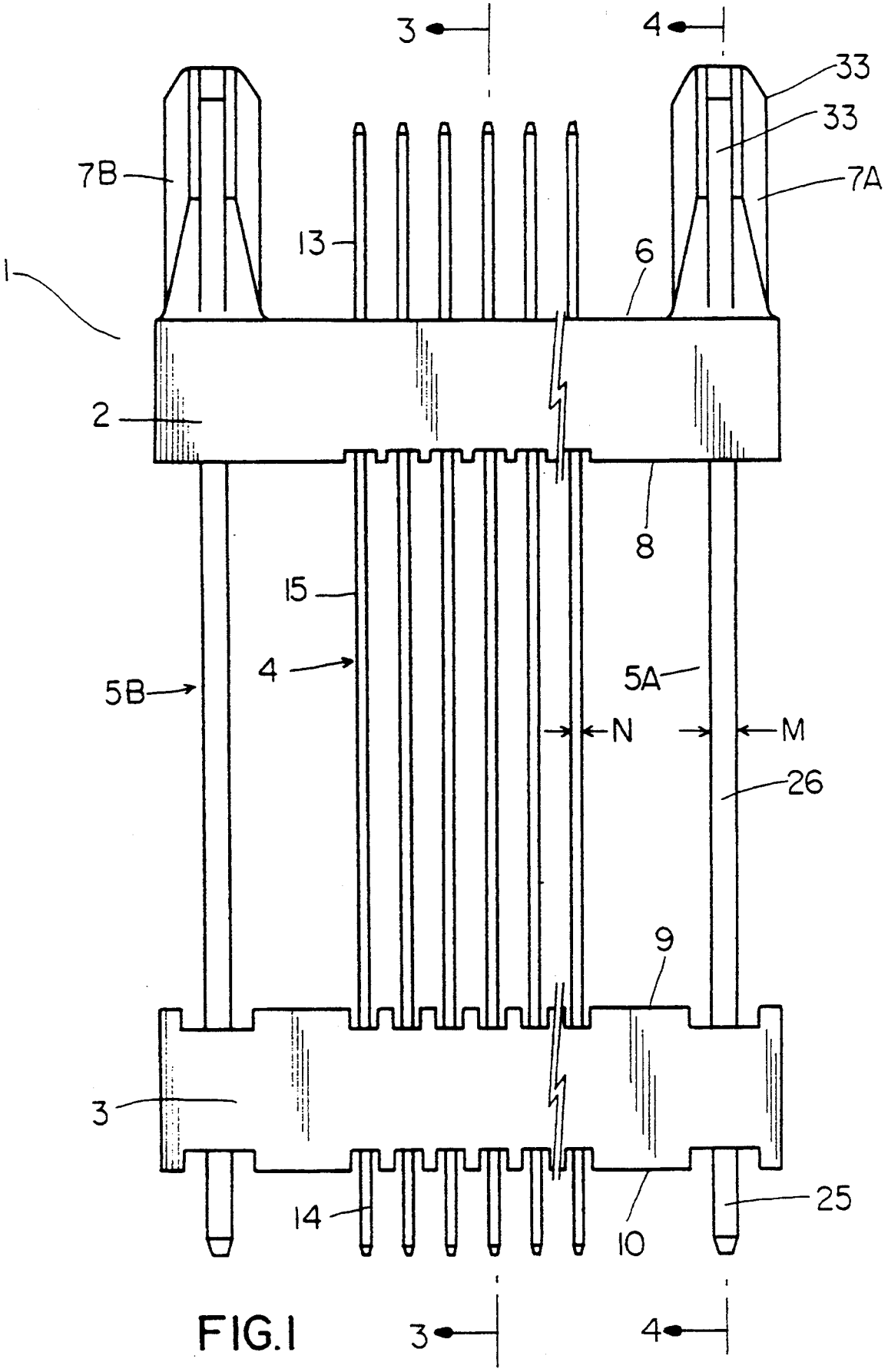
FIG. 1 is a front view of an electric connector for connecting printed circuit boards according to an embodiment of the present invention.
Figure 2:
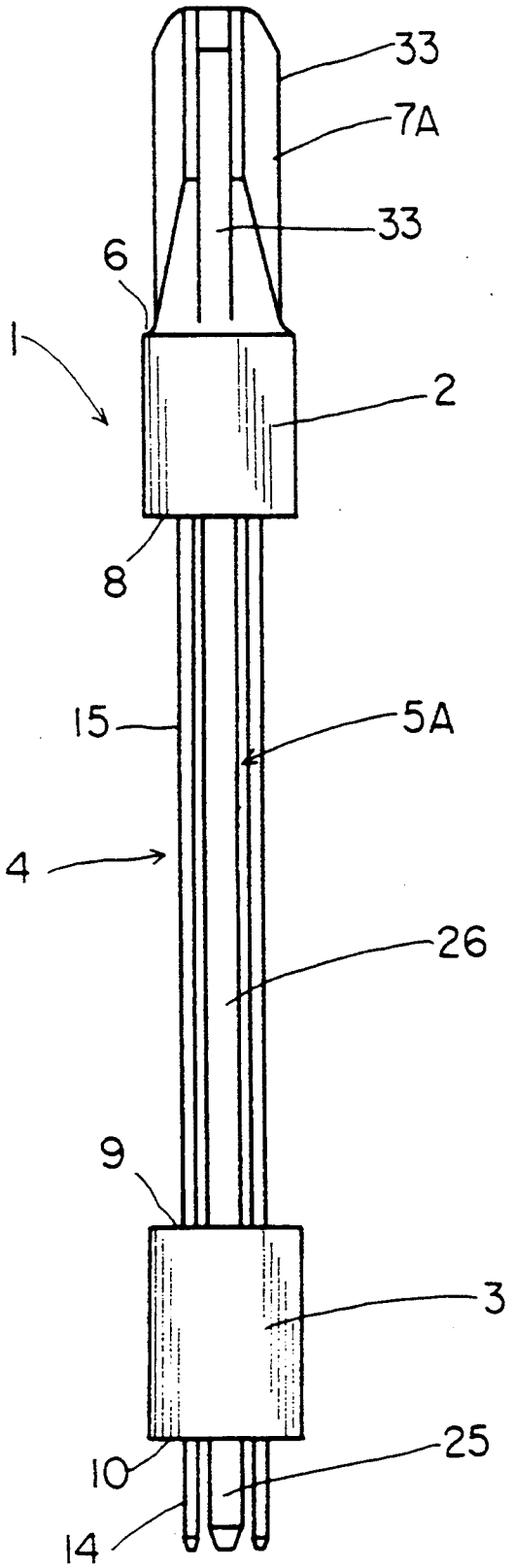
FIG. 2 is a side view of the electric connector as seen from the right side in FIG. 1.

Referring to FIGS. 1 to 6, an electric connector 1 has an upper wafer 2 and a lower wafer 3, which is separate from the upper wafer 2 and lying in planes parallel to one another. These wafers are molded of plastic. As shown, a plurality of needle-like pin terminals 4 are arranged laterally at regular intervals between the upper and lower wafers 2 and 3.

The opposite ends of the wafers 2 and 3 are connected by two tie rods 5A and 5B. The diameter M of the tie rods is much larger than the diameter N of the needle-like pin terminals. This larger diameter will release more rigidity and accordingly more resistance to lateral movement of the pair of printed circuit boards than the rigidity of the needle like pin terminals. The upper wafer 2 has two board-attaching projections 7A and 7B integrally connected to its opposite ends which hold and locate the upper wafer 2 to the adjacent printed circuit board 34.

The upper wafer 2 has as many pin receiving openings 11 as the pin terminals 4, made at regular intervals, and the pin terminals 4 pass through these openings 11 to appear beyond the upper surface of the upper wafer 2. Likewise, the lower wafer 3 has as many pin receiving openings 12 as the pin terminals 4, made at regular intervals, and the pin terminals 4 pass through these openings 12 to appear beyond the lower surface of the lower wafer 3. Thus, each pin terminal 4 is separated into the upper section 13 extending beyond the upper wafer 2, the intermediate section 15 between the upper and lower wafers 2 and 3, and the lower section 14 extending beyond the lower wafer 3.

Figure 3:
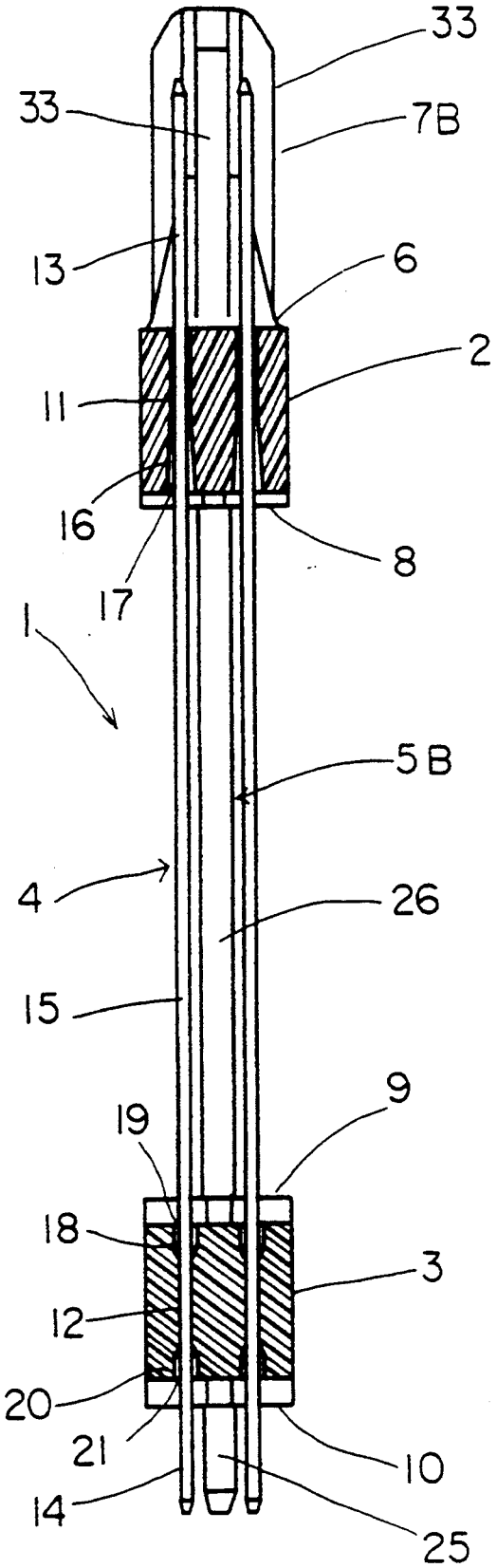
FIG. 3 is a sectional view taken along the line 3—3 in FIG. 1.

As best seen from FIG. 3, the pin-receiving openings 11 of the upper wafer 2 are divergent toward the lower surface 8 of the upper wafer 2 having an increased diameter to define annular gaps 17 around the pin terminals 4. Also, the pin receiving openings 12 of the lower wafer 3 have an increased diameter 18 at their upper ends to define annular gaps 19 around the pin terminals 4. Likewise, in this particular embodiment, the pin receiving openings 12 have an increased diameter 20 at their lower ends to define annular gaps 21 around the pin terminals 4.

Figure 4:
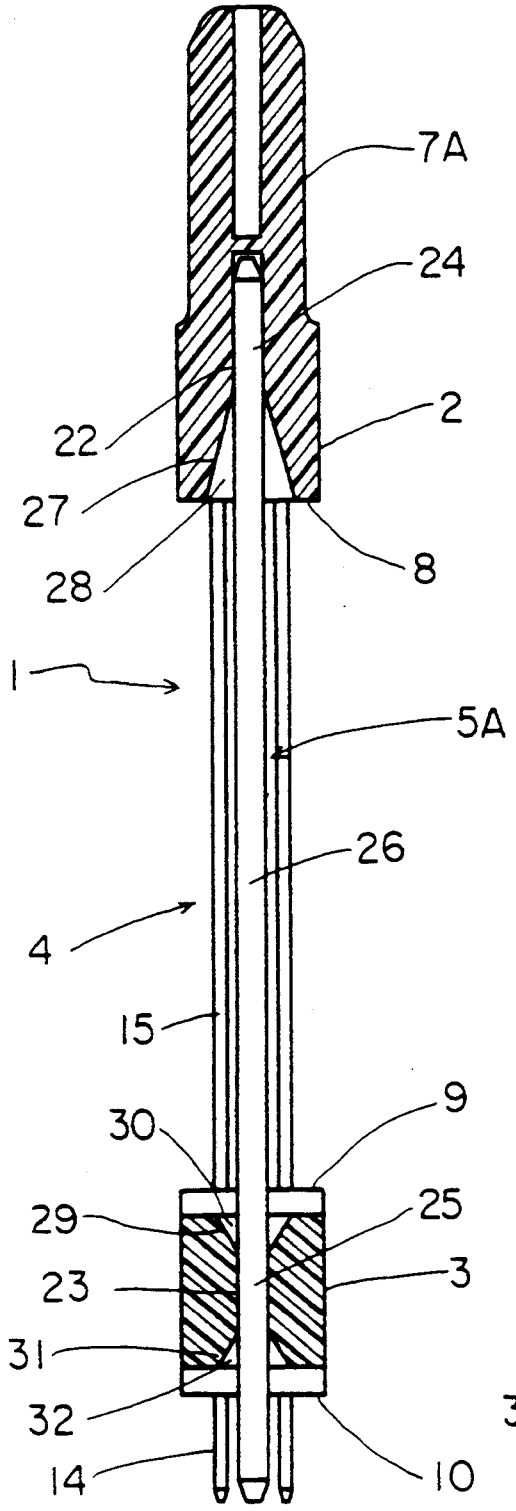
FIG. 4 is a sectional view taken along the line 4—4 in FIG. 1.
Figure 6:
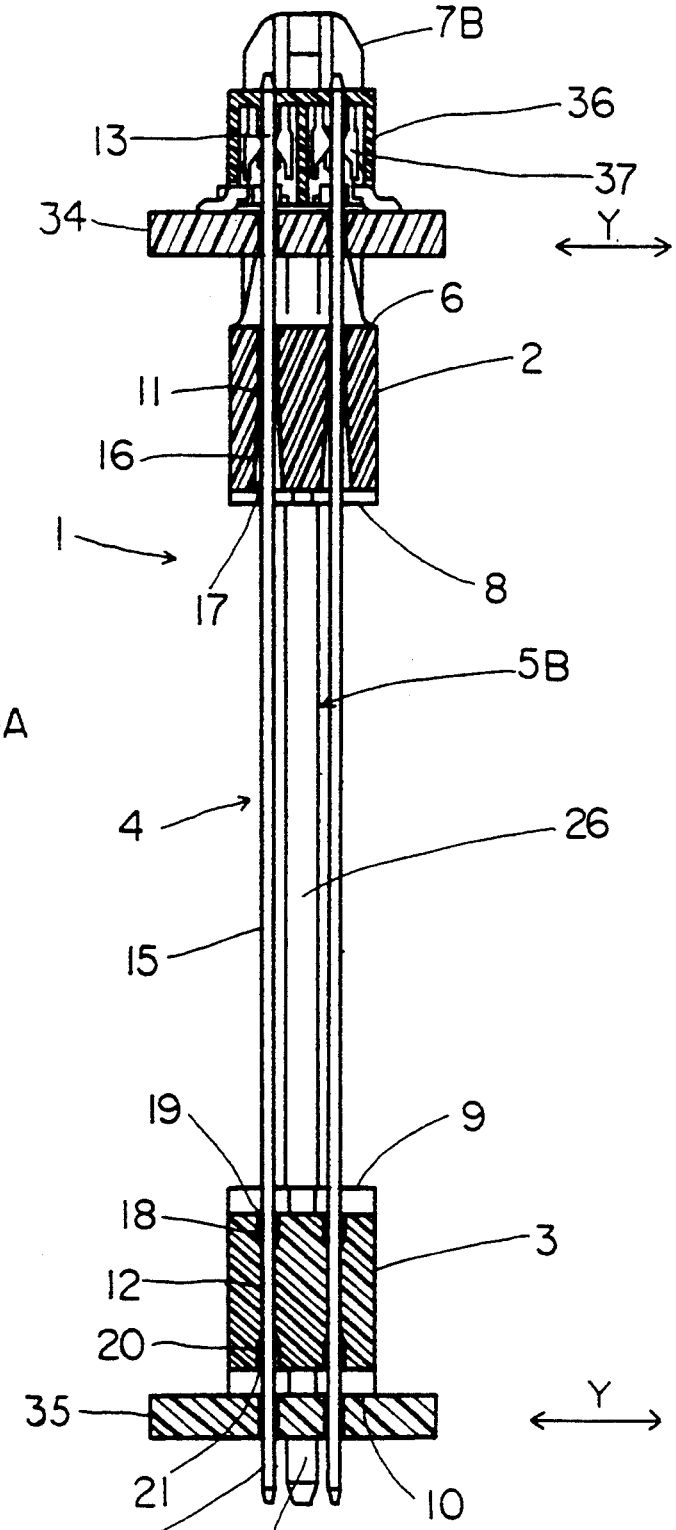
FIG. 6 is a longitudinal section taken along line 6—6 in FIG. 5 of the electric connector connecting the upper printed circuit board to the lower printed circuit board.
Figure 5:
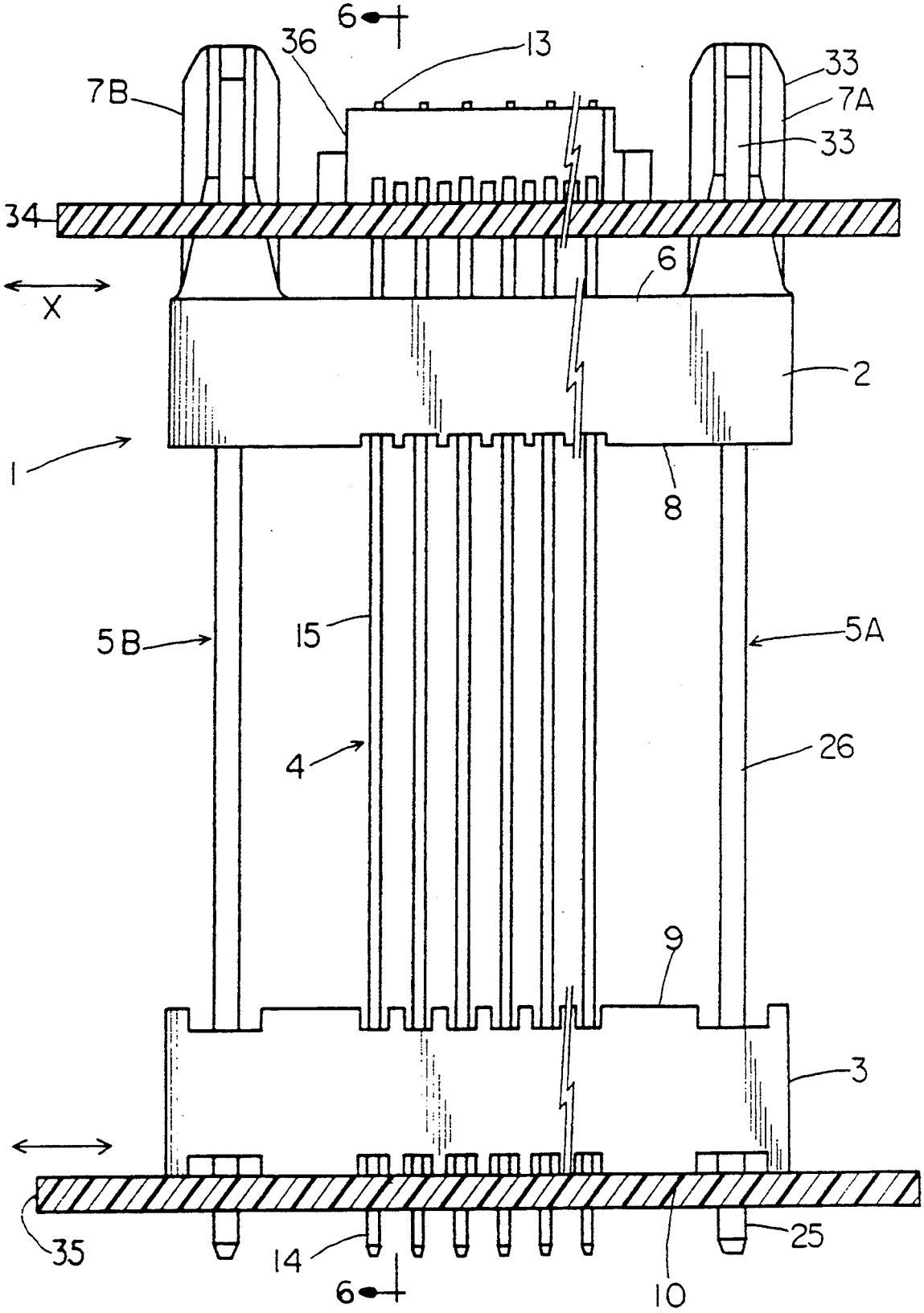
FIG. 5 is a front view of the electric connector connecting an upper printed circuit board to a lower printed circuit board.

As best shown in FIG. 4, the upper wafer 2 has two tie rod-insertion blind apertures 22 made on the opposite ends of its lower surface 8, and the lower wafer 3 has corresponding tie rod-insertion through apertures 23 made therein. The upper sections 24 of the tie rods 5A and 5B are inserted into the blind tie rod-insertion apertures 22 of the upper wafer 2 until the ends of the upper sections 24 contact the bottom of the aperture 22. The lower sections 25 of the tie-rods 5A and 5B are inserted in the tie rod-insertion through apertures 23 of the lower wafer 3 until their lower sections 25 appear beyond the lower wafer 3, leaving their intermediate sections 26 between the upper and lower wafers 2 and 3. Each tie rod-insertion blind aperture 22 is divergent toward the lower surface 8 of the upper wafer 2 to define an upward tapering inner wall 27, leaving an annular gap 28 around the tie-rod pin 5A or 5B. Likewise, each tie rod-insertion through aperture 23 is divergent toward the upper and lower surfaces 9 and 10 of the lower pin mount 3 to define upward and downward tapering inner walls 30 and 32 respectively, leaving annular gaps 30 and 32 around the tie rod pin 5A or 5B. In FIGS. 5 and 6 ribs are indicated by 33, upper printed circuit board by 34, a lower printed circuit board by 35, a female connector by 36, and terminal pieces of the female connector by 37.

As shown in FIG. 5 and 6, the upper sections 13 of the pin terminals 4 appearing above the upper surface 6 of the upper wafer 2 are inserted in selected holes in printed circuit board 34 until they come into contact with terminal pieces 37 of the female connector 36, which is attached to the printed circuit board 34. Also, the lower sections 14 of the pin terminals 4 appearing below the lower surface 10 of the lower pin mount 3 are inserted in selected holes in another printed circuit board 35 until they come into contact with selected conductors on the printed circuit board 35. The opposite board-attaching projections 7A and 7B of the upper wafer 2 are fitted into corresponding holes (not shown) in the upper printed circuit board 34, and at the same time, the lower sections 25 of the tie rods appearing beyond the lower wafer 3 are fitted into corresponding holes (not shown) in the lower printed circuit board 35. Thus, an electric connection is made between the upper and lower printed circuit boards 34 and 35.

The upper and lower printed circuit boards may be fixed to associated devices at positions somewhat apart from the prescribed position as, for example, in the left or right direction as indicated by X in FIG. 5 or in the forward or rearward direction as indicated by Y in FIG. 6. Under such circumstances, the intermediate sections 15 and 26 of the pin terminals 4 and opposite tie rods 5A and 5B are yieldingly bent to absorb a predetermined amount of such positional deviations, while permitting the required electrical connection to be maintained between the upper and lower printed circuit board 34 and 35.

Figure 9:
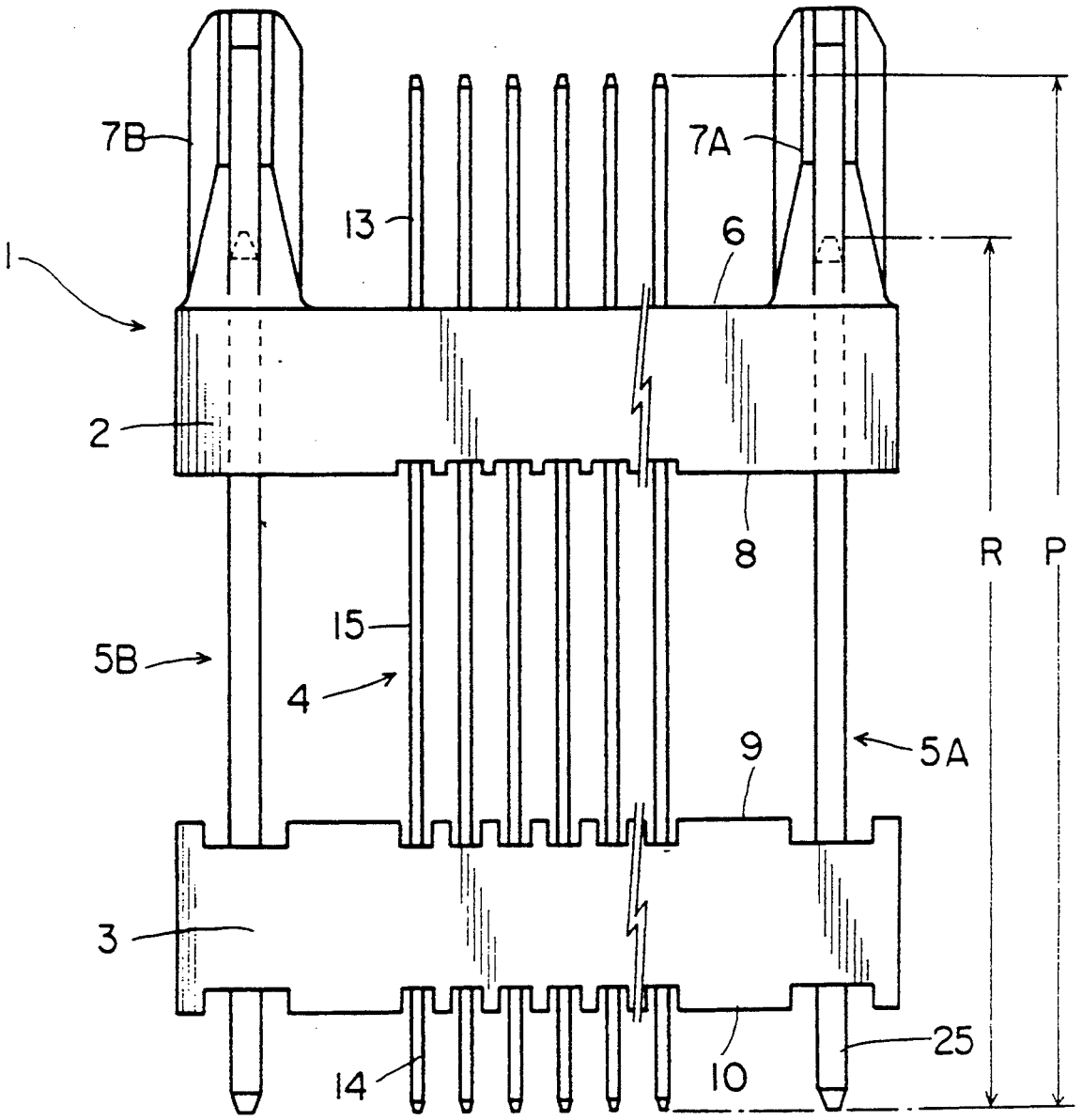
FIG. 9 is a front view of an electric connector according to another embodiment, which can be provided by using pin terminals and opposite tie rods of short length in place of pin terminals and opposite tie rods of long length in FIG. 1.

The electric connector 1 may be used to connect two parallel printed circuit boards which are separated a first distance, and another similar electric connector 1 may be used to connect two additional printed circuit boards which are separated a second distance. Under such circumstances, the pin terminals 4 and tie rods 5A and 5B are simply removed from the holes 11, 12 and 22, 23 of the upper and lower wafers 2 and 3, and the pin terminals 4 and tie rods 5A and 5B of appropriate lengths P and R are substituted to make up an electric connector to connect the printed circuit boards separated by a second distance, as seen from FIG. 9. As may be understood, a variety of sets of pin terminals and tie rods of different lengths are prepared to meet a variety of distances between the printed circuit boards. Use of metal tie rods of increased diameter provides a relatively strong assembly.

Figure 7:
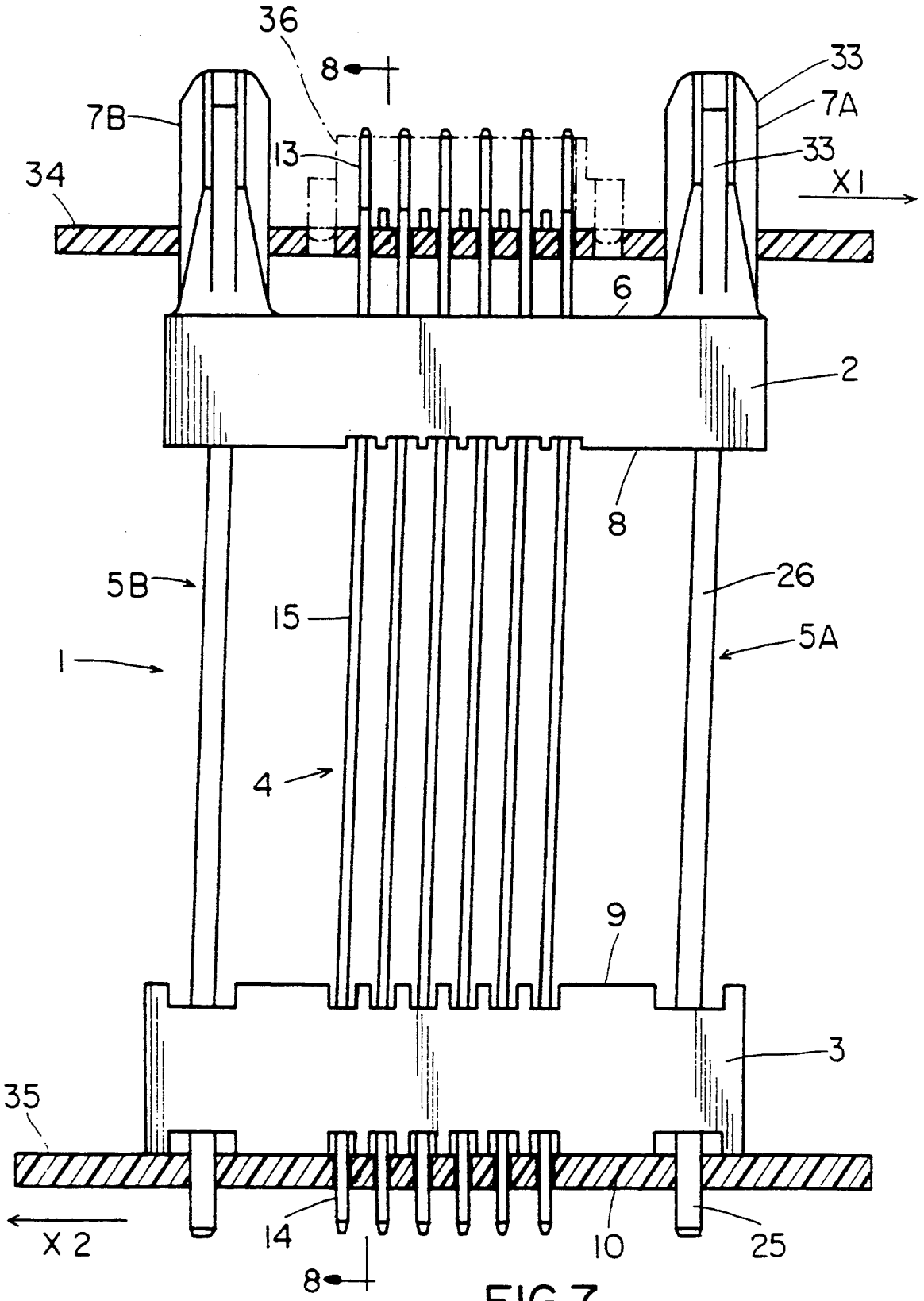
FIG. 7 shows the manner in which the electric connector connects the upper printed circuit board to the lower printed circuit board when these printed circuit boards are deviated from the aligned position in the X—X direction.
Figure 8:
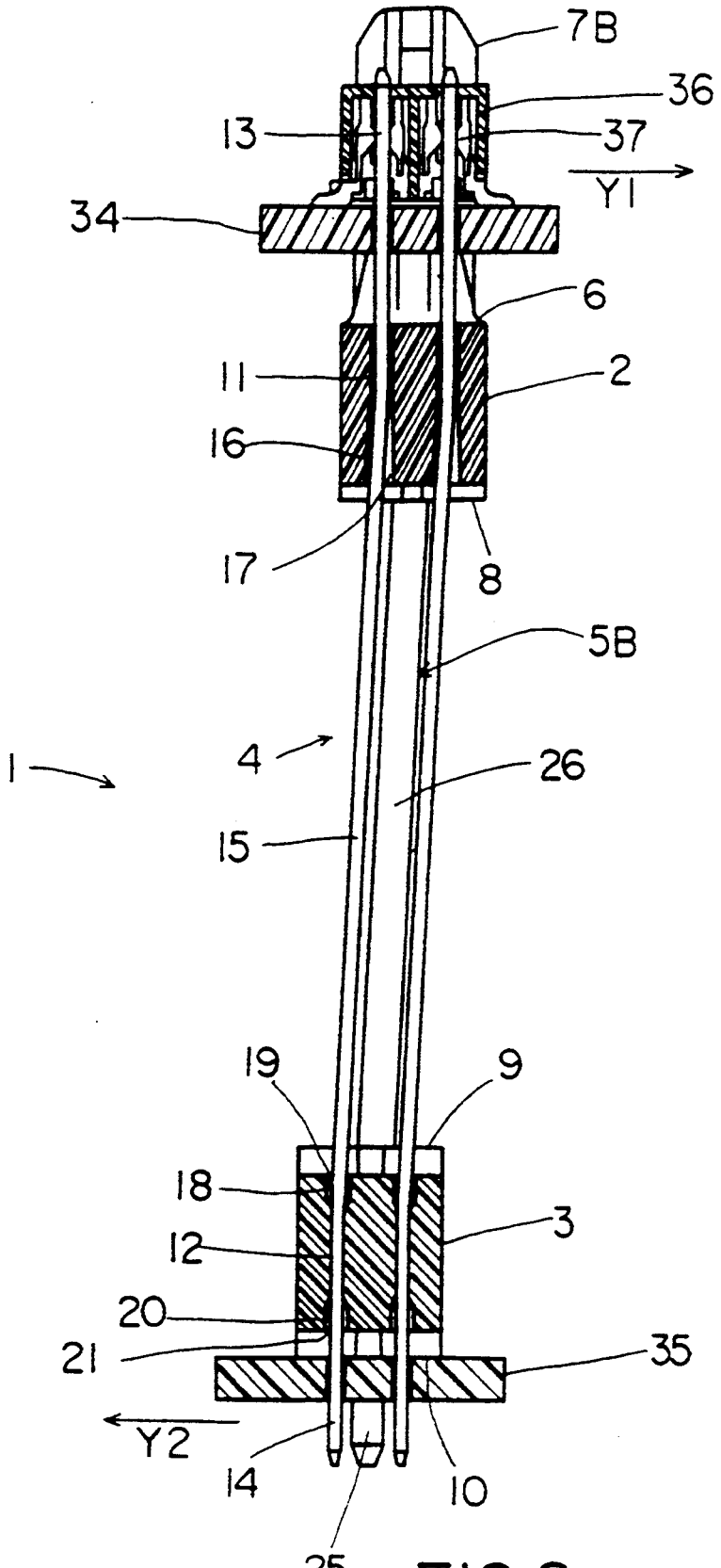
FIG. 8 is a longitudinal section taken along line 8—8 in FIG. 7 showing the manner in which the electric connector connects the upper printed circuit board to the lower printed circuit board when these printed circuit boards are deviated from the aligned position in the Y—Y direction.

FIG. 7 shows the manner in which the electric connector 1 makes a required electric connection between the upper and lower printed circuit boards 34 and 35 when the upper printed circuit board 34 is located somewhat apart from the prescribed position in the right direction as indicated by X1, and when the lower printed circuit board 35 is located somewhat apart from the prescribed position is the left direction as indicated by X2. FIG. 8 shows the manner in which the electric connector 1 makes a required electric connection between the upper and lower printed circuit boards 34 and 35 when the upper printed circuit board 34 is displaced from the prescribed position somewhat in the rearward direction as indicated by Y1, and when the lower printed circuit board 35 is displaced from the prescribed position somewhat in the frontward direction as indicated by Y2. As seen from these drawings, the intermediate sections 15 of the pin terminals 4 and the intermediate sections 26 of the tie-rods 5A and 5B are yieldingly bent so as to absorb such positional deviations of the upper and lower printed circuit boards 34 and 35 from the prescribed positions. More specifically, referring to FIG. 8, the tapering holes 11 of the upper wafer 2 permit the intermediate sections 15 of the pin terminals 4 to be yieldingly bent without excessive stress, still allowing the upper sections 13 of the pin terminals 4 to stand erect, thus assuring that the pin terminals 4 are kept inserted in the female connector in a stable position. Likewise, the enlarged upper sections 19 of the through openings 12 of the lower wafer 3 permit the intermediate sections 15 of the pin terminals 4 to be yieldingly bent without excessive stress, still allowing the lower sections 14 of the pin terminals 4 to stand erect. FIGS. 7 and 8 show the positional deviations of the upper and lower printed circuit boards 34 and 35 and the bending of the pin terminals 4 in an exaggerated way. The upper sections 13 of the pin terminals 4 to be inserted in the female connector 36 and the lower sections 14 of the pin terminals 4 to come to contact with selected conductors in the lower printed circuit board 35 can stand erect, assuring that a precise electric connection is made between these printed circuit boards. Similarly, the divergent apertures 28 and 30 of the upper and lower wafers 2 and 3 permit the opposite tie-rods 5A and 5b to be yieldingly bent so as to absorb positional deviations if any. In this particular embodiment the tie rods 5A and 5b are described as having an increased diameter, compared with the pin terminals 4. These tie rods, however, may be of the same diameter as pin terminals, provided that an appropriate metal is selected to give a good mechanical strength to the connector assembly, thus having sufficient rigidity to resist lateral movement caused by positional deviations between the printed circuit boards.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An arrangement including a connector interconnecting two spaced apart, parallel printed circuit boards, said connector including:

a pair of dielectric wafers, each wafer having a plurality of pin receiving openings therein alignable with each other, one wafer mounted adjacent one board and the second wafer mounted adjacent the other board, a plurality of conductive pin terminals, each adapted to be received in corresponding openings of both wafers such that the ends of the terminals extend beyond their respective wafer into the printed circuit boards and the wafers are axially spaced-apart along the terminals, the improvement comprising:

at least two support rods mounted between the two wafers, each support rod press fit into an aperture in both wafers and each support rod being stiffer than said terminals, whereby the support rods add rigidity and stability in the arrangement so that the boards will not move relative to one another beyond a predetermined amount thereby preventing over stressing of the terminals, the terminal receiving openings of at least one wafer being greater than or equal to the cross section of the terminals to allow the terminals to slide within the openings when the boards move relative to one another.

2. An arrangement according to claim 1 wherein said pin receiving openings in at least one of said pair of wafers each having an increased diameter at its end facing the other one of said pair of wafers, said increase in diameters defining annular gaps around said pin terminals wherein said gaps allow the pins to bend without placing high stress at the portion of the pin exiting one wafer toward the other wafer.

3. An arrangement according to claim 2 wherein one of said pair of wafers having board attaching projections which locate and hold said wafer in a printed circuit board.

4. An arrangement according to claim 2 wherein said apertures into which said support rods are press fit, each having an increased diameter at its end facing the other end of said pair of wafers, said increase in diameters defining annular gaps around said support rods wherein said gaps allow the support rods to bend without placing a high stress at a portion of the support rod exiting a wafer through said gap.

5. An arrangement according to claim 2 wherein each of said pin receiving openings of one of said wafers has a tapering wall extending from said gap to define a hole gradually decreasing in its diameter.

* * * * *